US006686700B1

(12) United States Patent
Hsu et al.

(10) Patent No.: US 6,686,700 B1
(45) Date of Patent: Feb. 3, 2004

(54) STRUCTURE OF A STRING OF SURFACE-CONTACTED FLASHER TYPE LAMPS

(75) Inventors: Chao Ming Hsu, Hsinchu (TW); Chin-Hua Lin, Hsinchu (TW); Yu-Chih Tseng Cheng, Hsinchu (TW)

(73) Assignee: Golden Shine Electric Co., Ltd., Hsinchu (TW)

( * ) Notice: Subject to any disclaimer, the term of this patent is extended or adjusted under 35 U.S.C. 154(b) by 0 days.

(21) Appl. No.: 10/347,199

(22) Filed: Jan. 21, 2003

(65) Prior Publication Data

(65)

(51) Int. Cl.[7] ..... H05B 37/00
(52) U.S. Cl. ..... 315/185 R; 315/185 S
(58) Field of Search ..... 315/185 R, 94, 315/100, 185 S, 101, 102, 105, 106, 71, 107, 50, 51

(56) References Cited

U.S. PATENT DOCUMENTS 6,107,746 A * 8/2000 Chen ..... 315/185 R
6,396,219 B1 * 5/2002 Tang ..... 315/185 S

* cited by examiner

*Primary Examiner*—Don Wong
*Assistant Examiner*—Chuc Tran
(74) *Attorney, Agent, or Firm*—Rosenberg, Klein & Lee

(57) ABSTRACT

The invention provides an improved structure of a string of surface-contacted flasher type lamps. Each flasher type lamp has a closed cover, and inside the cover, there are two conducting lines. Each conducting line has an inner end point and a concave portion, and the inner end points of the conducting lines are located inside the cover, whereas the other ends of the conducting lines penetrate through the cover to the outside. A heat-resistant fuse is connected between the inner end points of the conducting lines, while a fuse is connected between the concave portions of the conducting lines. A core ball with diamond-shape surfaces is located under the fuse wrapping the two conducting lines. Each of the compound metal heat leaning slices is welded to one of the conducting lines in a position between the inner end point and the concave portion of the conducting line. When the heat-resistant fuse is conducting and emitting heat, the compound metal heat leaning slices will bend and touch each other due to receiving heat; therefore, a short circuit occurs. The short circuit stops the heat-resistant fuse from conducting, which in turn will cause the temperature inside the cover to drop. The compound metal heat leaning slices will be separated due to the lowered temperature, and then the heat-resistant fuse will be conducting again and emitting heat. Hence, the flashing effect of a flasher type lamp can be obtained.

4 Claims, 8 Drawing Sheets

STRUCTURE OF A STRING OF SURFACE-CONTACTED FLASHER TYPE LAMPS

BACKGROUND OF THE INVENTION

1. Field of the Invention

The invention relates to decorative flasher type lamps and, more particularly, to an improved structure of a string of surface-contacted flasher type lamps that have high acuteness and high stability.

2. Description of the Related Art

Referring to FIG. 1, a conventional decorative flasher type lamp 1 contains a single-piece compound metal heat leaning slice 11. When the tungsten filament 14 inside the flasher type lamp 1 is emitting heat and its temperature is getting higher, the compound metal heat leaning slice 11 will bend due to receiving heat and touch the filament 15. The contact between the slice 11 and the filament 15 leads to a short circuit, which causes the tungsten filament 14 inside the bulb to be extinguished and the temperature inside the bulb to drop. Consequently, the compound metal heat leaning slice 11 will also cools down and eventually will be separated from the filament 15. In turn, the separation will lighten up the tungsten filament 14 again; therefore, the compound metal heat leaning slice 11 will come into contact with and depart from the filament 15 repeatedly, causing a flashing effect inside the bulb. However, point discharge will occur when the compound metal heat leaning slice 11 touches the filament 15, which will cause the compound metal heat leaning slice 11 to be fatigued. In addition, because the filament above the core ball 13 is a straight line, the fuse 12 that coils around the filament will slip off easily; therefore, the effect of protecting the circuits cannot be achieved properly. In viewing of the above-mentioned shortcomings, the invention provides a surface-contacted flasher type lamp to improve the shortcomings.

SUMMARY OF THE INVENTION

The main object of the invention is to provide a surface-contacted flasher type lamp that contains two-piece compound metal heat leaning slices so as to make the lamp short circuited by a surface contact, and to produce a surface-contacted flasher type lamp with high acuteness and stability in order to prevent from the shortcomings of the conventional flasher type lamp, which means that the metal fatigue can be avoided since it may occur in the conventional flasher type lamp due to point discharge caused by the point contact.

Another object of the invention is to provide a conducting line with a concave portion, which allows the fuses to steadily coil around the conducting line.

Also, another object of the invention is to provide a core ball with diamond-shape surfaces, which refracts the emitted light and increase the visual sense of beauty.

DESCRIPTION OF THE PREFERRED EMBODIMENTS

Figure 1:
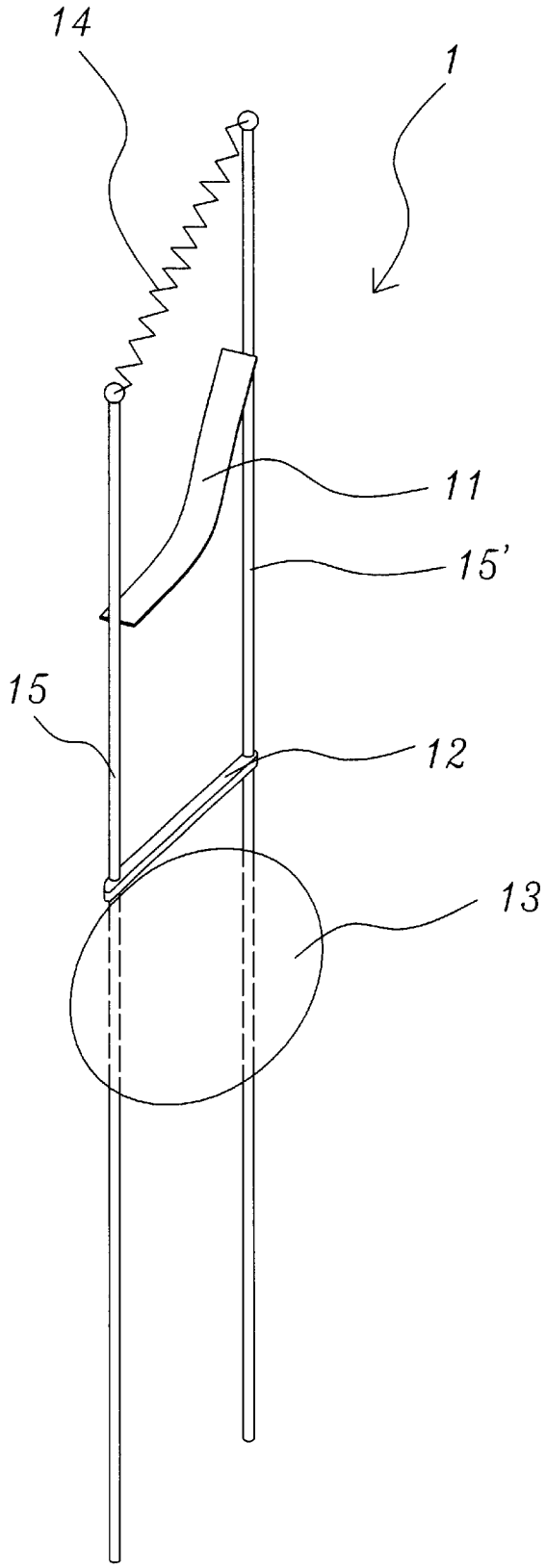
FIG. 1 is a schematic diagram showing the structure of a conventional decorative flasher type lamp.
Figure 2:
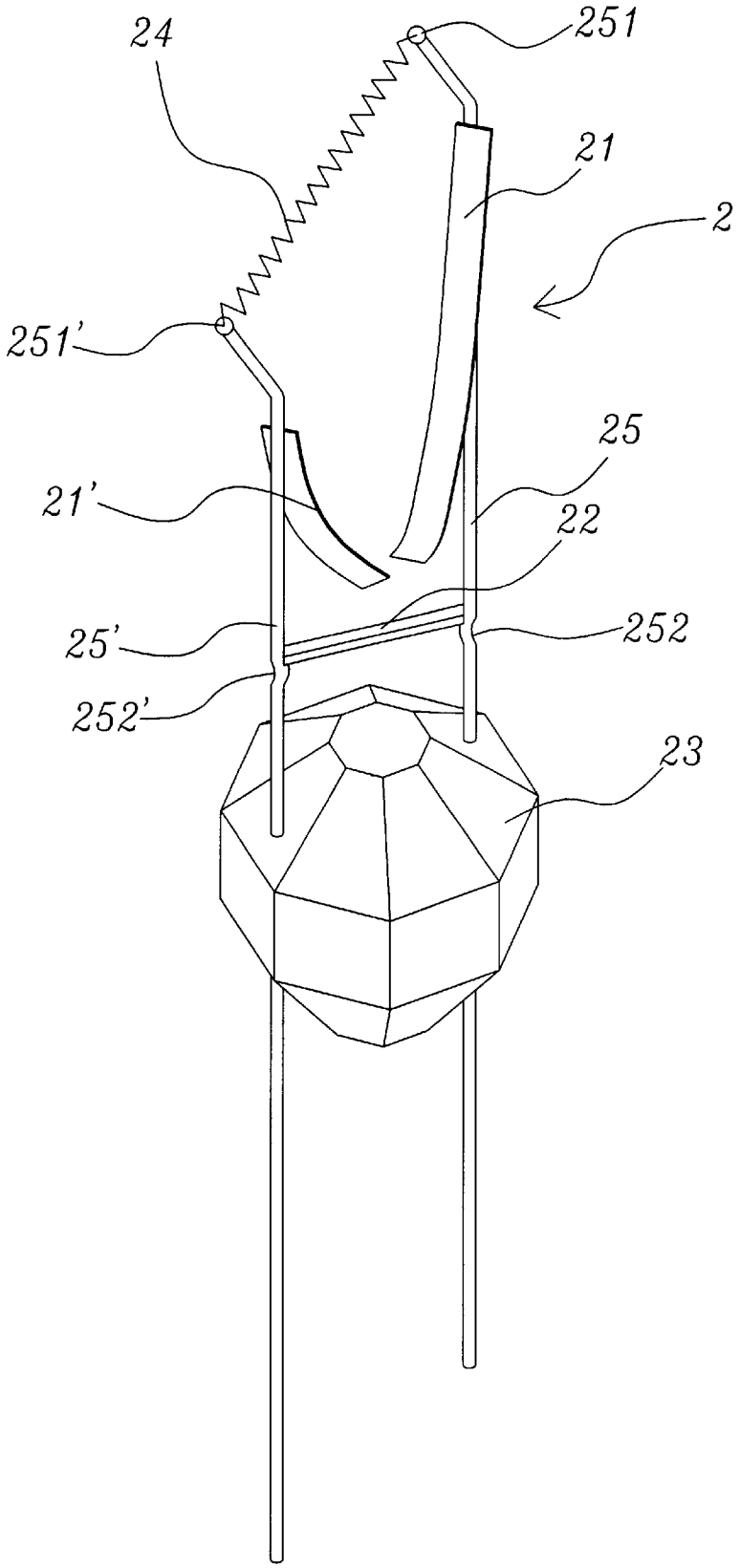
FIG. 2 is a schematic diagram showing the structure of the invention.

FIG. 2 is a schematic diagram showing the structure of the invention. Referring to FIG. 2, the flasher type lamp of the invention has a cover (not shown), and inside the cover there are two conducting lines 25 and 25'. The conducting lines 25 and 25' include inner end points 251 and 251' respectively and concave portions 252 and 252' respectively. The inner end points 251 and 251' of the conducting lines are located inside the cover, but the other two ends of the conducting lines penetrate through the cover to the outside. Heat-resistant fuse 24 is connected between the two inner end points of the conducting lines, whereas a fuse 22 is connected between the two concave portions 252 and 252'. Under the fuse 22, there is a core ball 23 with diamond-shape surfaces wrapping the two conducting lines 25 and 25'. The compound metal heat leaning slices 21 and 21' are welded to the conducting lines 25 and 25' respectively at positions between the inner end points 251 and 251' and the concave portions 252 and 252'.

Figure 3B:
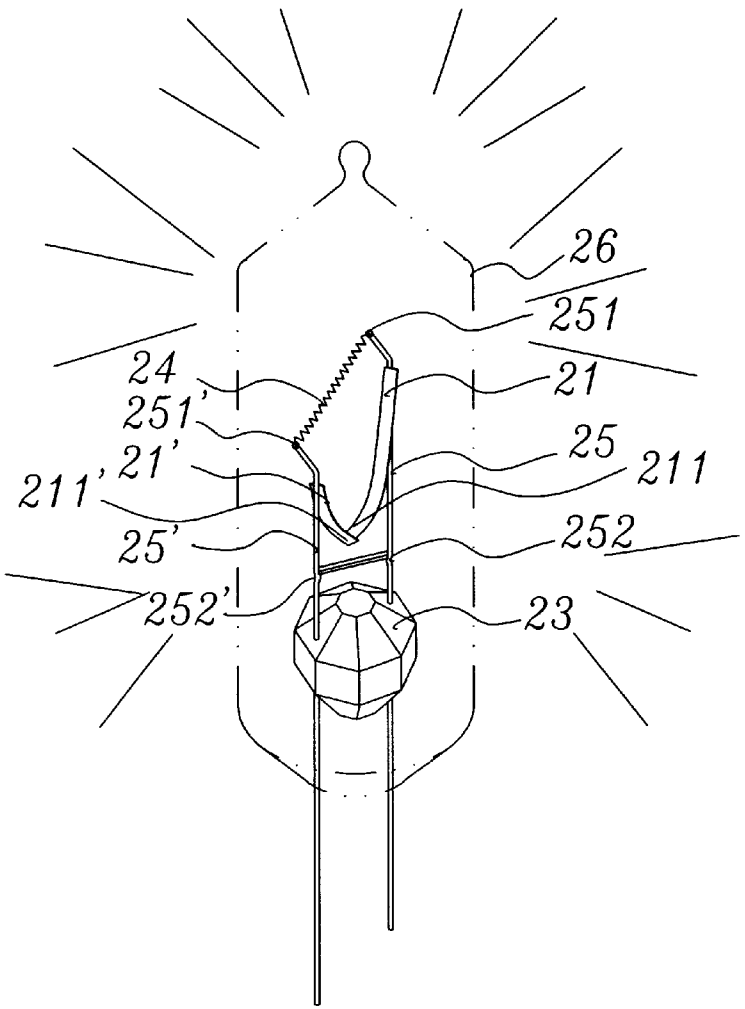
FIG. 3*b* is a schematic diagram showing that the heat-resistant fuse of the invention is emitting light.
Figure 3A:
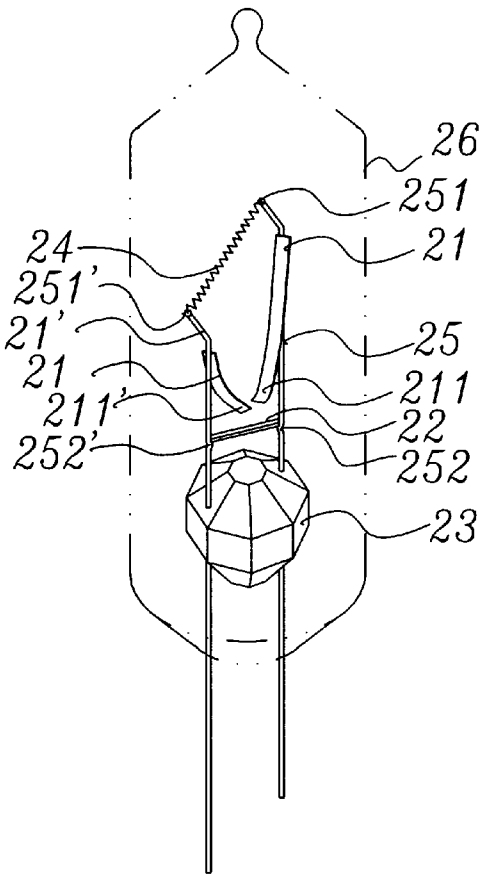
FIG. 3*a* is a schematic diagram showing that the heat-resistant fuse of the invention is not emitting light.
Figure 4:
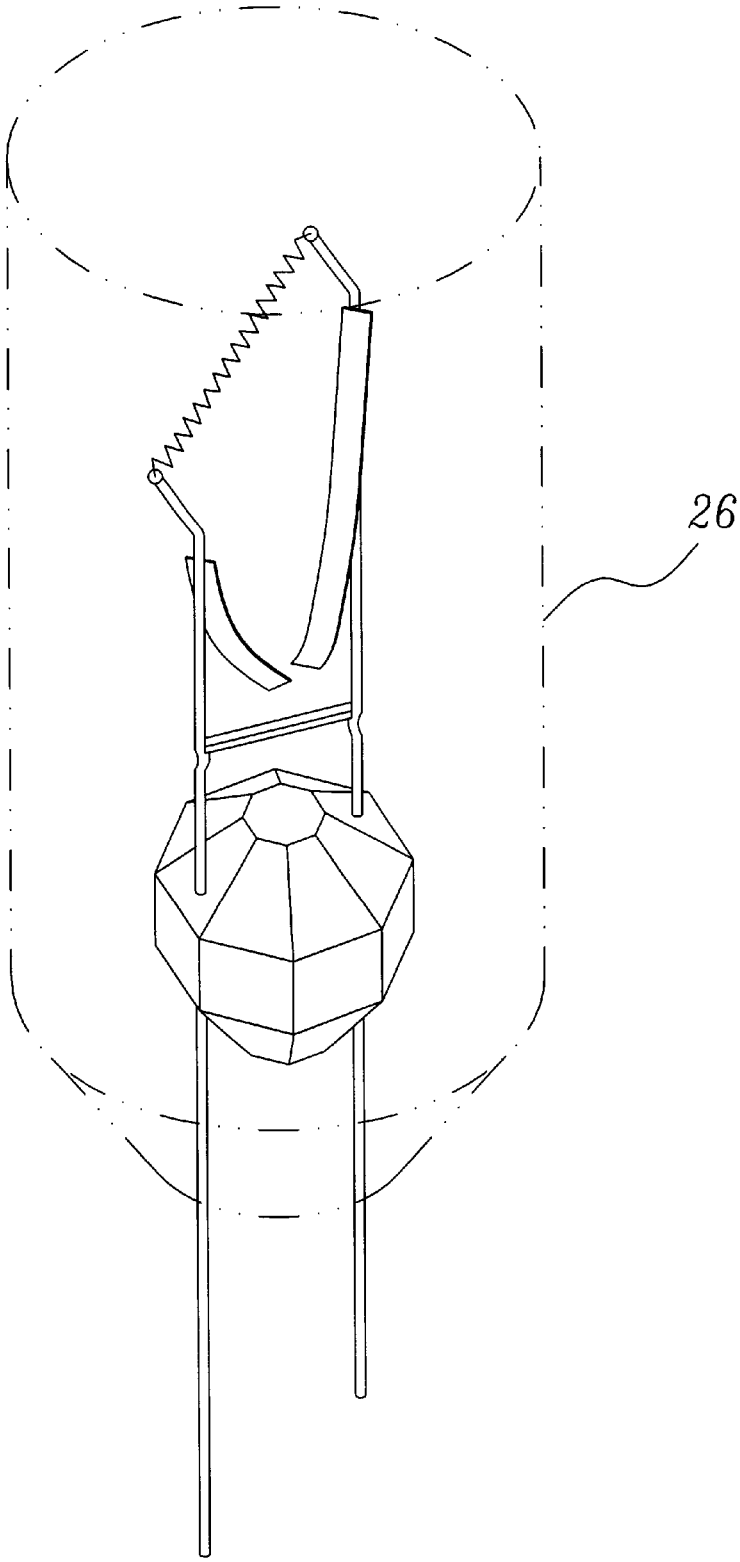
FIG. 4 is a schematic diagram showing an embodiment of the invention.
Figure 5:
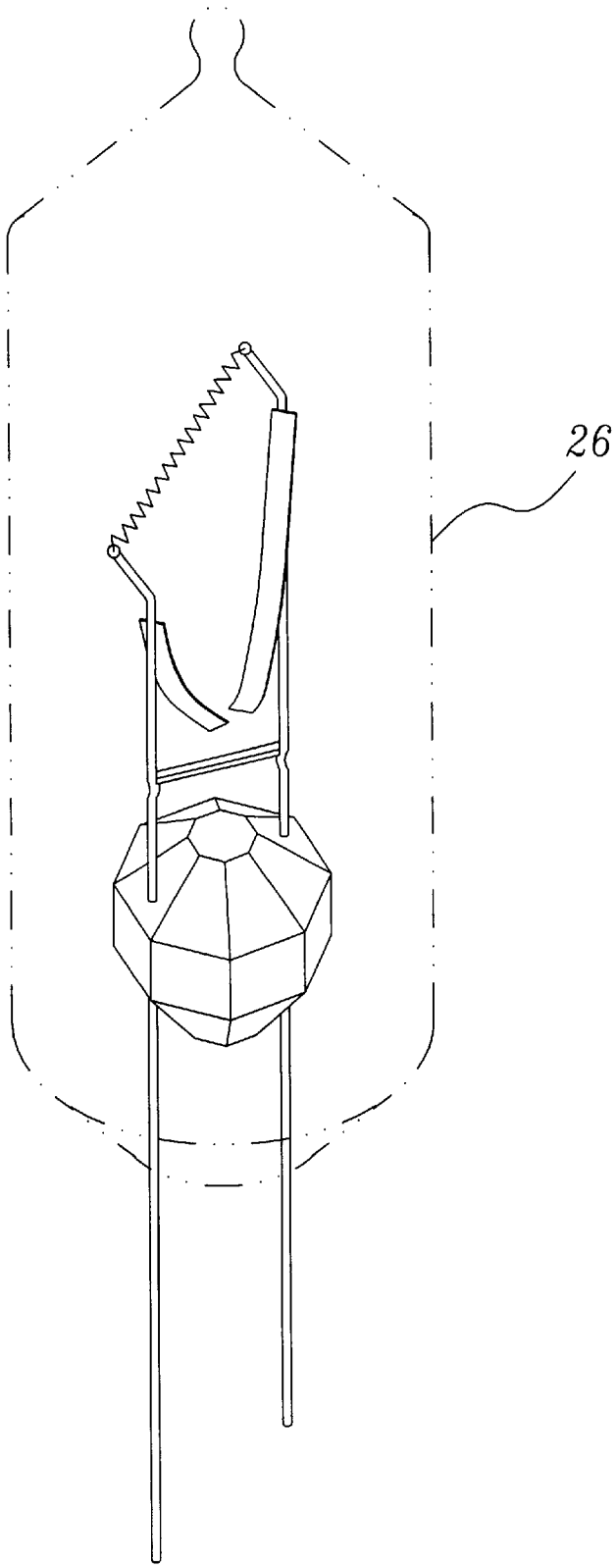
FIG. 5 is a schematic diagram showing another embodiment of the invention.
Figure 6:
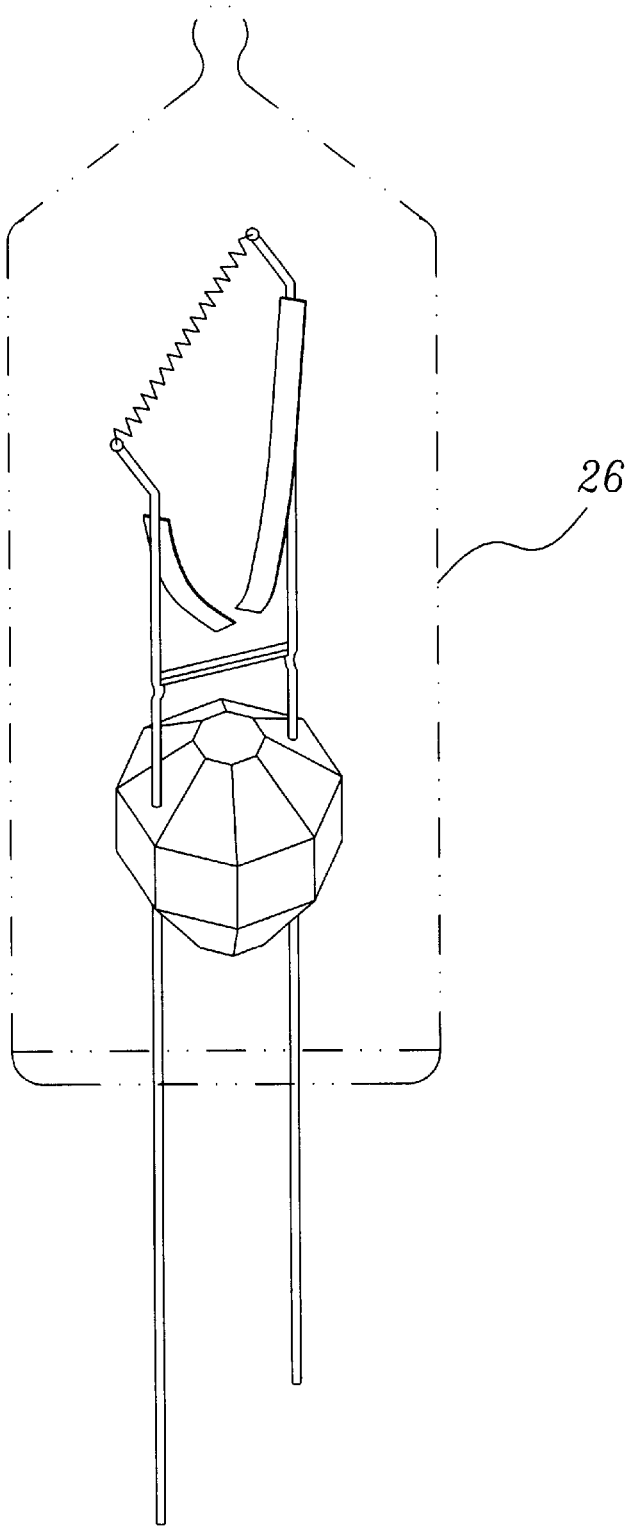
FIG. 6 is a schematic diagram showing another embodiment of the invention.
Figure 7:
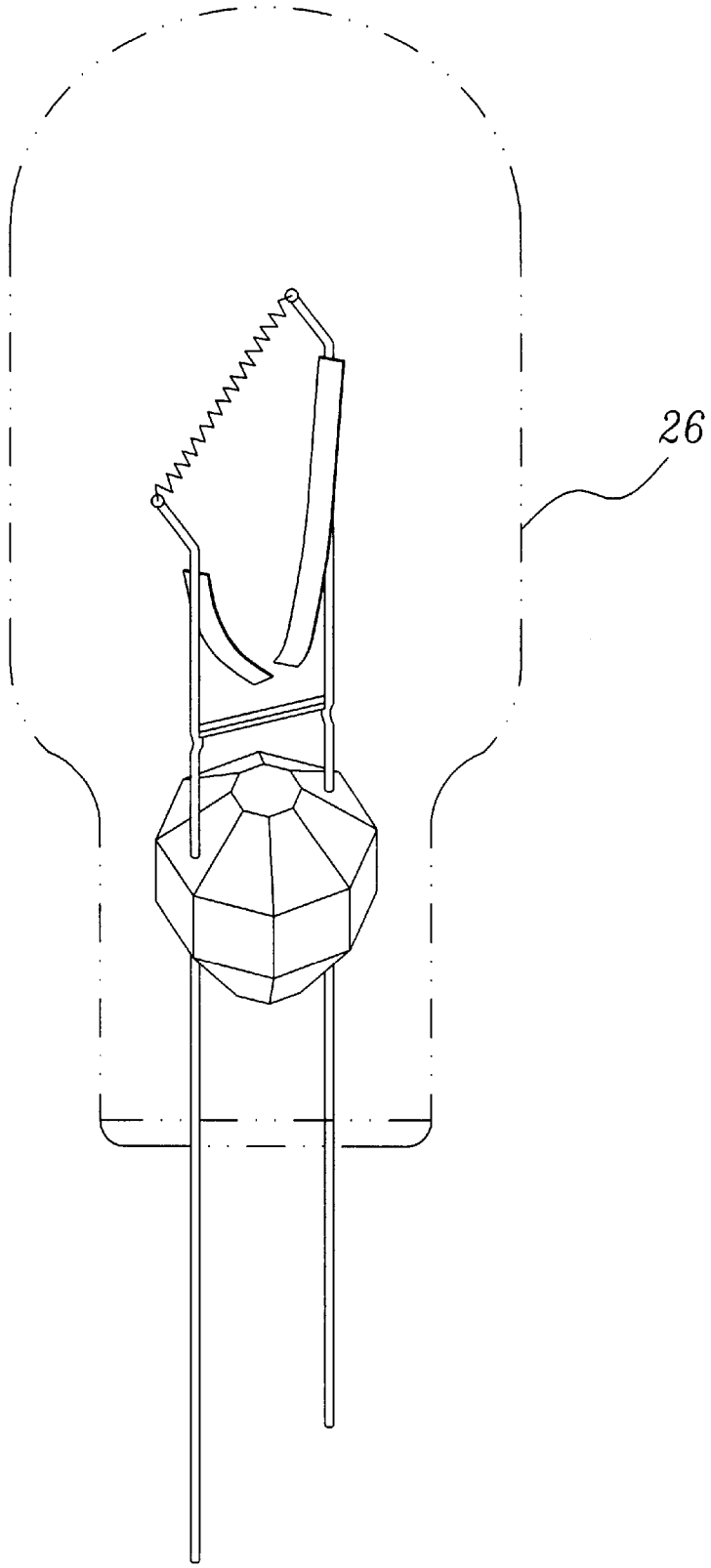
FIG. 7 is a schematic diagram showing another embodiment of the invention.
Figure 8:
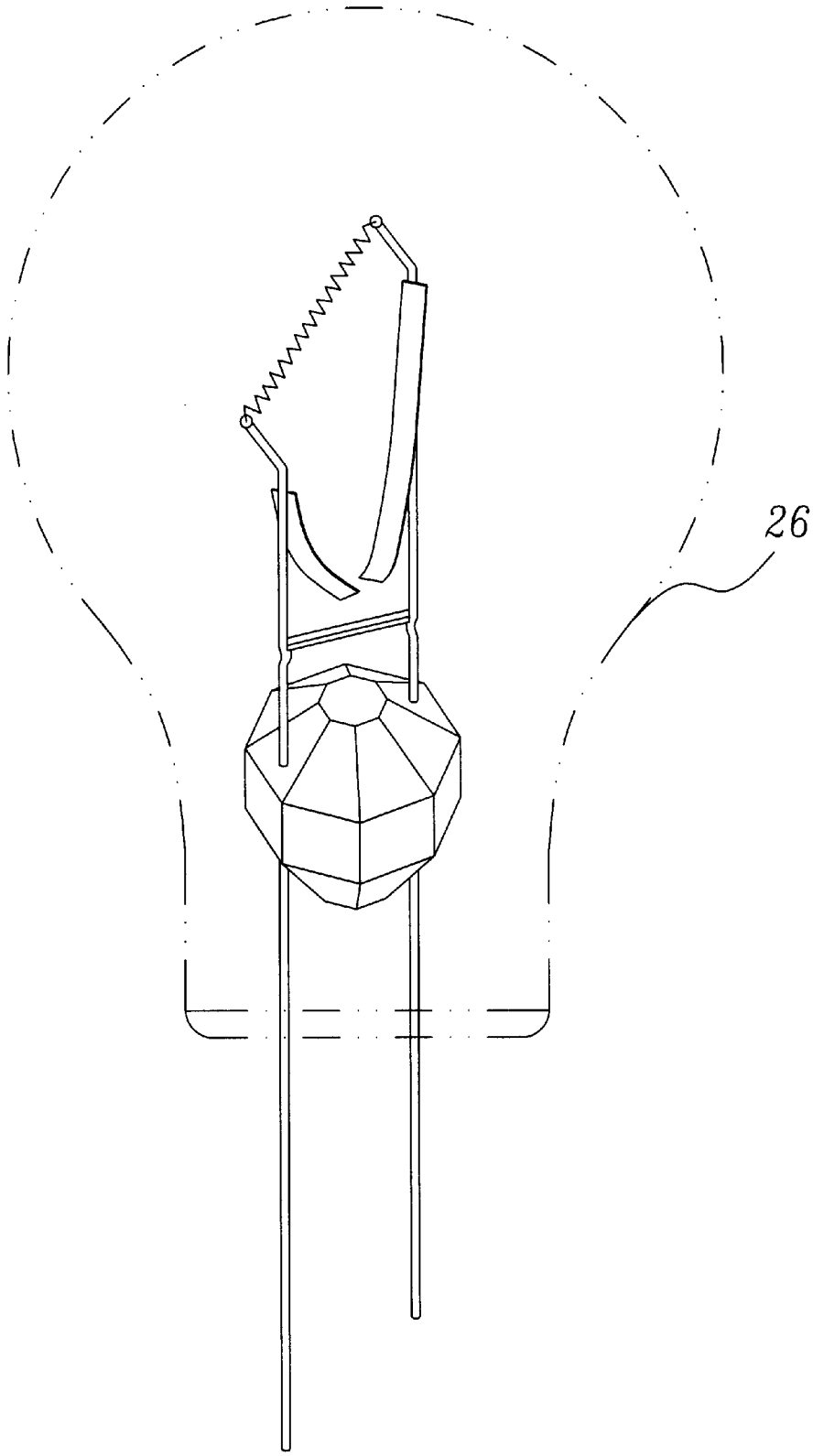
FIG. 8 is a schematic diagram showing another embodiment of the invention.

Referring to FIG. 3*a*, when the two conducting lines 25 and 25' of the surface-contacted flasher type lamp 2 are off, the heat-resistant fuse 24 (preferred to be tungsten filament) is also off and, therefore, no heat is emitted. Being under the normal temperature, the compound metal heat leaning slices 21 and 21' will then keep a certain distance from each other. On the other hand, referring to FIG. 3*b*, when the two conducting lines 25 and 25' of the surface-contacted flasher type lamp 2 are on, the heat-resistant fuse 24 will emit heat because of the conduction, making the temperature inside the cover 26 become higher. Because of the high temperature, the compound metal heat leaning slices 21 and 21' begin to bend until each of the front surfaces 211 and 211' of the slices touches each other, which is followed by a short circuit. After the two front ends of the slices have touched each other and generated a short circuit, the currents will flow passing through the compound metal heat leaning slices, making the heat-resistant fuse 24 extinguish again because of the off-conducting state. Consequently, the temperature inside the cover 26 will drop, and the two front ends of the compound metal heat leaning slices will be separated from each other to a certain distance again because the temperature has gone back to normal, as shown in FIG. 3. Thus, if the conducting lines of the surface-contacted flasher type lamp 2 continue to be in an off-and-on state as mentioned above, the compound metal heat leaning slices will respond to the state with either touching each other or not touching each other repeatedly. Similarly, the heat-resistant fuse 24 in turn will respond to the state with either being conducting or being extinguished accordingly. Meanwhile, when the heat-resistant fuse 24 emits light in an on state, the core ball 23 with diamond-shape surfaces will refract the light to generate a more stunning flashing effect. In addition, the fuse 22 of the invention is placed between the concave portions 252 and 252'; therefore, the location of the fuse 22 is secured enough to avoid slipping off. Moreover, when the currents passing through the conducting lines 25 and 25' are excessive in amount, the fuse 22 will burn down itself to protect the internal circuits of the surface-contacted flasher type lamp 2.

FIG. 4 to FIG. 8 are embodiments of the invention, which all have the same internal structure. The major difference among them is that the design of cover 26 can be varied. Therefore, in the invention, there is no limitation set for the design of the cover. It is preferred that the cover is a cylinder, a conical cylinder, a circle, or an ellipse.

To sum up, the shortcoming of the conventional decorative flasher type lamp 1 is that the metal fatigue will occur when the single-piece compound metal heat leaning slice 11 of the flasher type lamp 1 touches the filament 15. To improve the shortcoming, the invention designs two-piece compound metal heat leaning slices allowing front surfaces 211 and 211' touch each other under a high temperature so that the point discharge caused by the conventional technique can be avoided. Hence, the surface-contacted flasher type lamp 2 can make twinkling illumination with more acuteness and stability.

The specific embodiments above are only intended to illustrate the invention; it does not, however, to limit the invention to the specific embodiments. Accordingly, various modifications and changes may be made without departing from the spirit and scope of the invention as described in the appended claims.

What is claimed is:

1. An improved structure of a string of surface-contacted flasher type lamps, including:

a closed cover;

a first conducting line having a first end point and a first concave portion portion, wherein one end of the first conducting line is located inside the cover, whereas the other end penetrates through the cover;

a second conducting line having a second end point and a second concave portion, wherein one end of the second conducting line is located inside the cover, whereas the other end penetrates through the cover;

a first piece of compound metal heat leaning slice located inside the cover, wherein one end of the first piece of compound metal heat leaning slice is connected between the first end point of the first conducting line and the first concave portion;

a second piece of compound metal heat leaning slice located inside the cover, wherein one end of the second piece of compound metal heat leaning slice is connected between the second end point of the second conducting line and the second concave portion;

a heat-resistant fuse located inside the cover and connected between the first end point and the second end point;

a fuse located inside the cover and connected between the first concave portion and the second concave portion; and a core ball located under the concave portions inside the cover, which wraps the other end of the first conducting line and the other end of the second conducting line, and each of the two ends is opposite to the first end point and the second end point respectively.

2. The improved structure of the string of surface-contacted flasher type lamps as claimed in claim 1, when the first end point and the second end point are not conducting electricity, the front surface of the first-piece of compound metal heat leaning slice is separated from the front surface of the second-piece of compound metal heat leaning slice with a certain distance.

3. The improved structure of the string of surface-contacted flasher type lamps as claimed in claim 1, when the first end point and the second end point are conducting electricity, the front surface of the first-piece of compound metal heat leaning slice touches the front surface of the second-piece of compound metal heat leaning slice and then results in a short circuit, which causes the conduction between the first end point and the second end point to be off.

4. The improved structure of the string of surface-contacted flasher type lamps as claimed in claim 1, wherein the heat-resistant fuse is a tungsten filament.

* * * * *